United States Patent [19]

Myers et al.

[11] 4,437,577

[45] Mar. 20, 1984

[54] DOUBLE SECONDARY SEAL FOR FLOATING ROOF TANKS

[76] Inventors: James F. Myers, First & Curtis Ave., Thorofare, N.J. 08086; Lloyd C. Thoemke, 3737 Chichester Ave., Boothwyn, Pa. 19061

[21] Appl. No.: 414,871

[22] Filed: Sep. 3, 1982

[51] Int. Cl.[3] ..... B65D 87/207

[52] U.S. Cl. ..... 220/224; 220/226; 220/218

[58] Field of Search ..... 220/216–227; 277/12, 32, 138

[56] References Cited

U.S. PATENT DOCUMENTS

| | | | |
|---|---|---|---|
| 2,108,380 | 2/1938 | Lentschewsky | 220/26 |
| 2,427,171 | 9/1947 | Wiggins | 220/26 |
| 2,459,178 | 1/1949 | Moyer | 220/26 |
| 2,551,403 | 5/1951 | Wiggins et al. | 220/26 |
| 2,897,998 | 8/1959 | Ulm | 220/26 |
| 2,981,438 | 4/1961 | Heisterberg | 220/26 |
| 3,043,468 | 7/1962 | Horner, Jr. | 220/26 |
| 3,275,183 | 9/1966 | Challenger | 220/26 |
| 3,589,549 | 6/1971 | Heisterberg | 220/222 |
| 3,618,813 | 11/1971 | Nishkian et al. | 220/220 |
| 4,004,708 | 1/1977 | Boyd | 220/226 X |
| 4,099,643 | 7/1978 | Wardwell et al. | 220/222 |
| 4,130,217 | 12/1978 | Hills et al. | 220/226 |
| 4,138,032 | 2/1979 | McCabe | 220/224 |
| 4,191,303 | 3/1980 | Kinghorn et al. | 220/222 |
| 4,273,250 | 6/1981 | Kinghorn, Sr. et al. | 220/220 |
| 4,308,968 | 1/1982 | Thiltgen et al. | 220/222 |

*Primary Examiner*—Robert S. Ward

*Attorney, Agent, or Firm*—Karl L. Spivak

[57] ABSTRACT

A double secondary seal for a floating roof type of liquid storage tank is disclosed. The secondary seal includes generally a weather shield of edge overlapping steel panels which extends upwardly and outwardly from the peripheral edge of the floating roof. The panels terminate upwardly in flexible wipers which are normally biased into sealing contact with the tank sidewall. A flexible vapor barrier underlies the steel panels to prevent the escape of vapors therethrough and defines a peripheral log space below the panels. A resilient foam log is positioned within the log space to provide a reserve seal. The dimensions of the foam log are designed to maintain the foam log away from contact with the tank sidewall when the wipers are in contact with the sidewall and assure sealing engagement of the foam log and the sidewall whenever the tank is filled sufficiently to raise the wipers above the top of the sidewalls.

19 Claims, 4 Drawing Figures

DOUBLE SECONDARY SEAL FOR FLOATING ROOF TANKS

BACKGROUND OF THE INVENTION

This invention relates in general to sealing systems for volatile liquid storage tanks, and in particular, is directed to a sealing system adapted to provide a vapor seal about the periphery of the roof of a floating roof type of liquid storage tank.

It is the common practice to store volatile liquids such as gasoline, jet fuels, light crude oil and the like in large, above ground, welded or riveted, steel storage tanks. Such tanks are generally characterized by cylindrical, welded or riveted steel sidewalls and a floating steel roof which is conventionally provided with suitable buoyancy devices to allow the floating type of roof to rise and fall within the tank sidewalls as the quantity of stored product increases and decreases.

Inherent in the floating roof type of tank design is a narrow annular space which is defined between the periphery of the floating roof and the tank sidewalls. This annular space must be great enough to accommodate any protrusions which extend inwardly of the tank sidewalls, for example, a rivet head as well as to provide suitable clearance to adjust for any irregularities from true round configuration in either the tank sidewalls or in the floating roof. In order to prevent loss of vapors through the annular space to thereby contaminate or pollute the ambient air, it has been the usual practice to provide some type of vapor barrier between the outer periphery of the floating roof and the inner periphery of the tank sidewalls. Many different sealing constructions have been developed by prior workers in the art to provide a suitable vapor barrier and these annular seals have generally been designated in the trade as the primary seal.

Recently, as concerns for environmental conditions have increased, more stringent requirements for hydrocarbon emission control to prevent vapor loss in and about the primary seal have been enacted. One such standard that is commonly followed at the present time has been promulgated by the California Air Resources Board and is generally designated as "Rule 463." In C.A.R.B. Rule 463, specific design parameters for floating roof tanks have been enumerated and tank secondary seal requirements have been set forth.

The C.A.R.B. Rule 463 requirements have now become so popular and so well recognized as to substantially be incorporated into all floating roof tank design standards in those communities wherein floating roof tank regulations have been adopted and enforced. The secondary seal design disclosed in U.S. Pat. No. 4,308,968 is exemplary of the type of secondary seal construction that must now be provided.

Most of the prior art secondary seal constructions, including the construction disclosed in U.S. Pat. No. 4,308,968, include an annular support structure comprising a plurality of circularly adjacent, flexible, steel, support plates. The support plates extend upwardly from the periphery of the floating roof structure for a distance that is usually between eighteen to twenty-four inches in order to assure adequate flexibility. The support plates are each bottomly bent to cause the plate to continuously flex radially outwardly toward the tank sidewalls. The support structure terminates upwardly in one or more flexible wipers, which wipers are maintained in intimate contact with the inner surface of the tank sidewalls by the flexure of the support plates to thereby provide a continuous, vertically sliding, vapor barrier to prevent the escape of volatile vapors at the secondary seal.

Of course, it will be appreciated that the secondary seal wipers must contact the inner surface of the tank sidewalls as the floating roof rises and falls to remain effective. Accordingly, the storage capacity of the tank itself is thereby limited by the elevated position of the wipers above the top of the floating roof. Care must be exercised to prevent the entrance of a quantity of product into the tank that is sufficient to elevate the floating roof to raise the secondary seal wipers above the top of the tank sidewall construction. It will be noted that, any vertical space that must be utilized to accommmodate the height that the secondary seal wipers are elevated above the top of the floating roof tank results in a corresponding loss of storage capacity within the tank. Thus, the installation of the secondary seals which employ the vertically elevated, flexible wipers has caused a corresponding decrease in storage capacity of the tank itself.

SUMMARY OF THE INVENTION

The present invention generally relates to the field of secondary seals in floating roof liquid storage tanks, and more particularly, is directed to a secondary seal which is designed to seal without a corresponding decrease in the storage capacity of the associated tank.

The secondary seal of the present invention is particularly designed and adapted for use above the primary seal and without interfering with the function of the existing primary seal. In the case of existing tanks, the primary seal usually had been previously provided at the annular space between the outer periphery of the floating roof of the tank and the inner periphery of the tank sidewall construction. The secondary seal of the present invention comprises generally a circular, metallic flexible weather shield or support structure which is mounted on the rim of the floating roof in known manner, for example, by employing a plurality of bolts which may be secured through the usual floating roof peripheral flange.

The weather shield extends circularly upwardly and outwardly of the floating roof periphery and defines an angle of approximately one hundred and twenty degrees from the plane of the roof. The weather shield or support structure include support plates which each carry two or more vertically stacked flexible wipers at the upper terminus or lip thereof. The support plates function to urge the plurality of wipers into continuous, overall, wiping contact with the inner surface of the tank sidewall.

In order to insure that the weather shield is sufficiently flexible so as to temporarily deform as may be necessary to conform to any irregularities in the floating roof or in the tank sidewall construction, preferably the weather shield is fabricated to comprise a plurality of similiar, metal, support plates, each of which is affixed securely to the peripheral flange of the floating roof. Preferably, the individual support plates overlap at the respective adjacent sides thereof to thereby provide a great degree of flexibility and to thus continuously urge the wipers into overall tank sidewall contact.

Inasmuch as the junctions between adjacent, overlapping support plates are not sealed or otherwise treated prevent the passage of volatile vapors, a flexible vapor barrier of known design extends about the entire periphery of the tank roof beneath the plurality of side overlapping weather shields or support plates. In a secure and relatively inexpensive method of fixation, preferably the lower edge of the vapor barrier is integrally connected at the junction between the plurality of support plates and the floating roof flange whereby the lower edge of vapor barrier can be secured in position at the same time that the plurality of weather shields are also affixed. The upper edge or upper limit of the vapor barrier is preferable connected to the upper edge of the weather shields at the same connection where at the wiper blades are affixed to the weather shield. In this manner, a single peripheral connection suffices to secure both the wiper blade and the upper extent of the vapor barrier to the tops of the plurality of individual weather shields.

The vapor barrier is fabricated of a height that is greater than the height of the weather shield so that a loose, annular space is defined between the vapor barrier and the bottom of the weather shield. Within the vapor barrier space is positioned a reserve seal which comprises an annular foam log, which log may be fabricated of a resilient, sturdy material, such as foam rubber or foam plastic.

In the preferred embodiment, the foam log which comprises the reserve seal is fabricated of triangular cross-section whereby one corner of the triangle will always be facing outwardly toward the inner periphery of the tank sidewall when one flat side of the triangular configuration is pressed against the outer face of the circular weather shield. The dimensions and configuration of the foam log should be maintained small enough so that the reserve seal can be positioned within the space defined between the vapor barrier and the weather shield and out of contact with the tank sidewall when the plurality of upper wipers are maintained in wiping arrangement against the inner periphery of the tank sidewall. The dimensions of the foam log should be sufficient to allow the log to contact and seal against the sidewall when the wipers override the top of the tank sidewall.

Whenever the liquid contents of the tank are increased sufficiently so that the wipers ride upwardly clear of the top of the tank sidewall, then the resiliency and flexibility of the circular weather shield functions to press an outer portion of the foam log into contact with the inner periphery of the tank sidewall (through the vapor barrier). In this manner, even though continued filling of the tank results in elevation of the wipers above the top of the tank, the secondary seal is not lost. During this additional filling, the foam log is squeezed between the outer surface of the weather shield and the inner surface of the tank sidewall to provide a reliable, annular, reserve secondary seal.

Thus, an existing storage tank may have its storage capacity substantially increased, while at the same time, the primary seal and the secondary seal function to meet all applicable air pollution standards which have been promulgated by authorities that presently have local jurisdiction over such volatile liquid storage facilities.

It is therefore an object of the present invention to provide an improved secondary seal for floating roof tanks of the type set forth.

It is another object of the present invention to provide a novel double secondary seal for a floating roof tank comprising in combination an upper sealing means and a lower sealing means.

It is another object of the present invention to provide a novel double secondary seal for floating roof tank which comprises a flexible weather shield annularly extending upwardly and outwardly from the tank floating roof, a continuous length of wiper upwardly affixed to the weather shield and extending outwardly in the direction of the tank sidewall, a gas-impervious flexible vapor barrier extending beneath the weather shield completely from the wiper connection to the floating roof connection, the vapor barrier defining a space beneath the flexible weather shield, and a foam log positioned within the space, the log being adapted to peripherally press against the inner surface of the tank sidewall whenever the wipers are elevated above the top of the sidewalls.

It is another object of the present invention to provide a novel double secondary seal for a floating roof tank that is simple in construction, inexpensive in fabrication and trouble free when in use.

Other objects and a fuller understanding of the invention will be had by referring to the following description and claims of a perferred embodiment thereof, taken in conjunction with the accompanying drawings, wherein like reference characters refer to similiar parts throughout the several views and in which:

DESCRIPTION OF THE PREFERRED EMBODIMENT OF THE INVENTION

Figure 1:
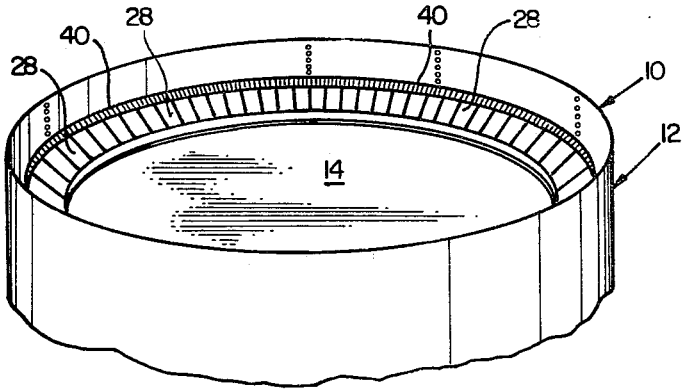
FIG. 1 is a perspective view showing the double secondary seal of the present invention installed on a floating roof type of volatile liquid storage tank.

Although specific terms are used in following description for the sake of clarity, these terms are intended to refer only to the particular structure of the invention selected for illustration in the drawings and are not intended to define or limit the scope of the invention.

Referring now to the drawings, a conventional volatile liquid storage tank 10 comprises generally a cylindrical sidewall construction 12 and a conventional floating roof 14, which roof is arranged for vertical movement within the tank sidewall 12 in response to variations in the height of the top of the liquid product (not illustrated) that is stored within the tank 10.

An annular clearance space 16 is defined between the outer periphery 18 of the floating roof 14 and the inner periphery 20 of the tank sidewall 12. A primary seal (not shown) is conventionally provided between the floating roof outer periphery 18 and the inner surface 20 of the tank sidewall 12 as required by various regulatory agencies in usual well-known manner and forms no part of the present invention. A secondary seal assembly 22 extends upwardly and outwardly from the floating roof periphery to sealingly engage the inner surface of the tank sidewall 12 in a manner to meet or exceed all known secondary seal regulations, particularly Rule 463 as promulgated by the California Air Resourses Board.

Figure 2:
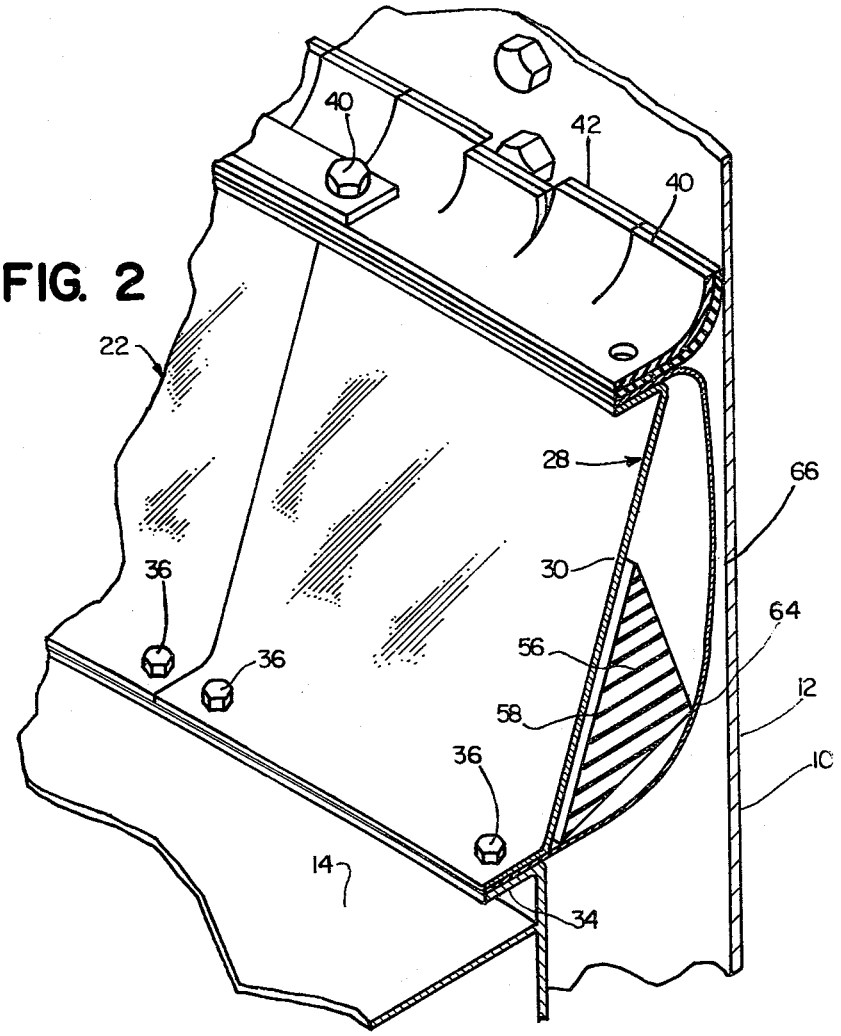
FIG. 2 is an enlarged, partial, perspective view showing a portion of the double secondary seal construction.
Figure 4:
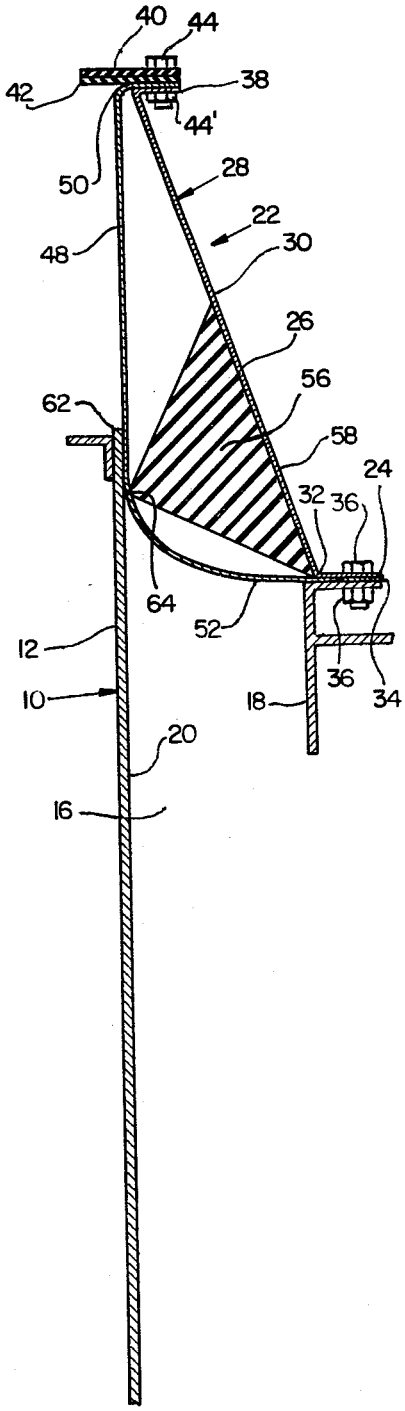
FIG. 4 is a cross-sectional view similar to FIG. 3 showing the roof in an elevated position with the wipers elevated above the top of the tank sidewall.
Figure 3:
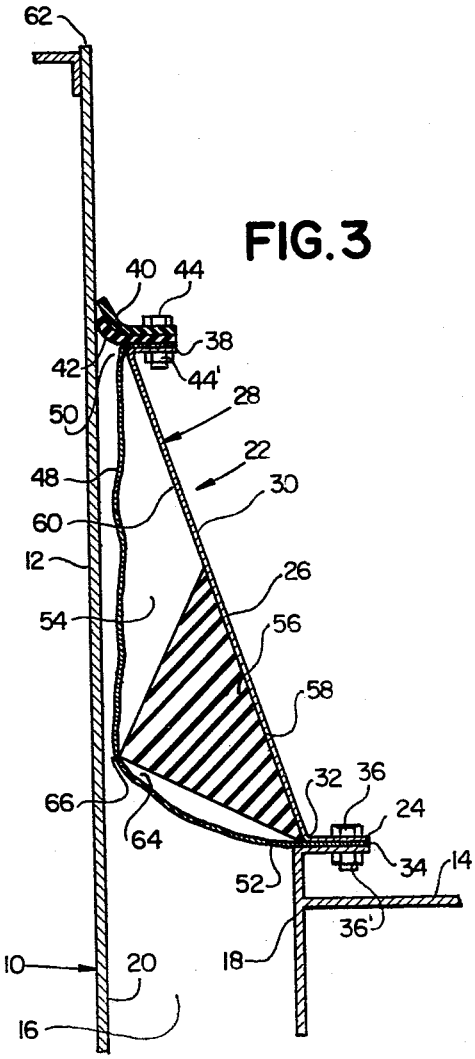
FIG. 3 is a cross-sectional view taken along line 3—3 on FIG. 2, showing the floating roof in a lower position and the wipers in contact with the tank sidewall.

Referring now to FIGS. 2 and 3, the secondary seal assembly 22 is illustrated extending upwardly and outwardly of the existing top flange 24 or other suitable construction usually found about the periphery of an existing floating roof 14 of a volatile liquid storage tank 10. In the embodiment illustrated, the secondary seal assembly 22 comprises generally a circular weather shield 26 which preferably is fabricated of a plurality of overlapping sheet metal sections or panels 28, which sections or panels can be readily conventionally formed of 16 gauge galvanized steel. The panels 28 are all fabricated to similiar bent cross sectional configurations. Each weather shield panel 28 comprises generally a planar body 30, which body is arranged to extend upwardly and outwardly of the floating roof periphery 18 at an angle of approximately one hundred and twenty degrees from the general plane of the roof 14. The planar body sections 30 each terminate downwardly in a bent lip 32, which lips are designed to extend in a generally horizontal alignment when the body sections 30 are arranged in approximately one hundred and twenty degree alignment with the plane of the floating roof 14.

In the usual manner, the floating roof 14 terminates radially outwardly in a peripheral flange 34 or other known construction, which construction is available for affixing the secondary seal assembly 22. Suitable fasteners, for example bolts 36 and nuts 36' can be employed about the flange in the usual manner to affix each weather shield panel bent lip 32 to the flange 34 about the entire periphery of the floating roof 14. When the nuts and bolts 36', 36 are secured in position, the plurality of weather shield panels 38 will be angularly oriented relative to the top of the floating roof to normally bias the upper edges of the panels outwardly. The natural spring of the 16 gauge galvanized sheet steel material of the panels and the overlapping edge junctions 46 of the panels 38 function to provide a flexible secondary seal assembly 22 above the top of the floating roof 14 and secured thereto for vapor sealing purposes as hereinafter more fully set forth.

Each weather shield panel 28 terminates upwardly in a bent flange 38, which flanges are preferably generally horizontally oriented when the weather shield panels are bolted to the floating roof peripheral flange 34. Accordingly, upon installation, the weather shield bent upper flanges 38 will generally be arranged in parallel, spaced relationship above the lower bent lips 32.

One or more natural rubber or neoprene resilient wipers 40, 42 are secured to the bent upper flanges 38 of the weather shield panels 28 in suitable, sturdy manner, for example, by employing a plurality of nut and bolt assemblies 44, 44. In order to prevent vapor leakage through the vertical junctions 46 between the weather shield panels 28, a continuous, circular vapor barrier 48 is employed about and beneath the entire weather shield 26 outwardly of the outer periphery 18 of the floating roof 14. Preferably, the vapor barrier 48 is fabricated of a length of flexible material that is suitably treated to resist the passage of volatile vapors eminating from the liquid product (not shown) that is stored within the tank 10. A length of flexible fabric material impregnated with a vapor impervious flexible material such as synthetic rubber or neoprene has been found suitable for this purpose.

As illustrated, the top periphery 50 of the vapor barrier 48 is secured to the top of the weather shield bent upper flange 38 together with the plurality of wipers 40, 42. Similiarly, the bottom periphery 52 of the vapor barrier 48 secures about the outer periphery of the floating roof 14 by being interconnected at the bolted connection between the weather shield bent lip 32 and the peripheral flange 34 of the floating roof 14. Accordingly, the vapor barrier 48 functions to prevent loss of volatile vapors through the various junctions 48 between adjacent panel sections 28. As illustrated, the vapor barrier 48 is constructed of sufficient height to loosely fall beneath the weather shield panels 28 to thereby provide a peripheral clearance space or log space 54.

As shown in FIGS. 2 and 3, an auxiliary or reserve seal in the form of a log 56 is positioned within the peripheral log space 54 to provide an auxiliary or reserve seal when the tank 10 is filled in the manner hereinafter more fully set forth. The auxiliary seal or log 56 optimally may be fabricated of foam rubber or foam plastic of suitable resiliency and body to seal against the inner periphery 20 of the tank sidewalls 12 when the tank is filled near its capacity. See FIG. 3.

In the embodiment illustrated, the foam log or seal 56 is fabricated of triangular cross-section to provide a most economical configuration. While the foam log or reserve seal 56 is illustrated in triangular cross-section, it will be appreciated that other cross-sectional shapes could also be employed, such as circular, rectangular, pentangular, hexangular, etc. The various cross-sectional configurations will produce satisfactory auxiliarly seals, but generally speaking, are more expensive in fabrication than the triangular cross-sectional shape illustrated. The configuration chosen must possess sufficient body to allow one extending portion to engage the tank sidewall when another, base portion contacts the undersides of the various overlapped weather shield panels 28.

In the illustrated embodiment, one straight side 58 of the foam log 56 is utilized as a base and positions in face to face contact with the outer surface or underside 60 of the weather shield 26. The side 58 may be cemented or otherwise secured to the outer weather shield surface 60 if so desired. However, preferably, it has been found by optimumly designing the height of the vapor barrier 48, the size of the log space 54 can be so controlled that the tension of the vapor barrier 48 itself will suffice to maintain the auxiliary shield 56 in place in general contact with the shield outer surface 60 as illustrated.

The height or cross-sectional thickness of the auxiliary seal 56 should be limited to a height that is less than the distance between the bottom of the weather shield 26 and the inner periphery 20 of the tank sidewall 20 when the wipers 40, 42 are engaged in wiping relationship upon the sidewall inner periphery 20. In this manner, the reserve seal will be inactive at all times when the wipers 40, 42 are in use to provide the required secondary seal. The height or thickness of the foam log 56 should be great enough to contact and press against the sidewall inner periphery 20 when the floating roof 14 is raised by filling sufficiently to elevate the wipers 40, 42 above the top 62 of the tank sidewall 12. The natural spring of the weather shield panels 28 that is normally utilized to bias the wipers 40, 42 against the tank sidewall 12 is also employed to urge the foam log 56 into sealing engagement with the sidewall.

In the elevated, full capacity position illustrated in FIG. 3, it will be observed that the raising of the floating roof 14 relative to the top 62 of the tank sidewall causes the plurality of wipers 40, 42 to rise above the sidewall top 60. Once the wipers 40, 42 clear above the top of the tank sidewalls 12, the secondary seal normally provided by the wipers will be lost. Immediately, the natural spring of the weather shield panels 28 will force the planar panal bodies 30 radially outwardly toward the tank sidewall 12 sufficiently to bias the apex 64 of the triangularly configured auxiliarly seal 56 against the inner periphery 20 of the cylindrical sidewall 12. Of course, if a cross-sectional configuration other than triangular as illustrated is employed, then the outermost portion of the foam log construction that extends normally from the weather shield outer surfaces 60 will be the portion of the foam log that engages against or presses against the tank sidewalls 12 to form the secondary seal.

In order to use the secondary seal assembly 22 of the present invention, a secondary seal assembly is fabricated with a plurality of overlapping weather shields 26, a continuous plurality of wipers 40, 42 and a continuous vapor barrier 48. The secondary seal assembly 22 is affixed at the outer periphery of the tank floating roof 14 and an auxiliary seal or reserve seal 56 is interposed in the peripheral reserve seal space 54 that is defined between the vapor barrier 48 and the outer surface 60 of the weather shield 26. The angle defined between the plane of the plurality of planar bodies 30 and the generally horizontal plane defined by the floating roof 14 is so designed as to urge the wipers 40, 42 into wiping contact with the inner periphery 20 of the tank sidewall above the floating roof in a manner to provide a suitable clearance space 66 between the reserve seal apex 64 and the tank sidewall inner periphery 20. The angle defined at the bottom bent lip 32 should be sufficient to always urge the wipers 40, 42 into continuous wiping engagement with the tank sidewall inner periphery 20.

Upon filling the storage tank 10 to near capacity, the floating roof 14 will be elevated with regard to the tank cylindrical sidewall 12 in the usual manner to thereby force the plurality of wipers 40, 42 above the top 62 of the tank sidewall. In this position, the natural spring built into the weather shield 26 will then urge the foam log apex 64 against the sidewall inner periphery 20 to thus form an acceptable, reserve, secondary seal even though the wipers 40, 42 are elevated above the top 62 of the tank sidewall. Accordingly, the secondary seal of the present invention permits substantially complete filling of the storage tank 10 without causing loss of the secondary seal.

Although the present invention has been described with reference to the particular embodiments herein set forth, it is understood that the present disclosure has been made only by way of example and that numerous changes in the details of construction may be resorted to without departing from the spirit and the scope of the invention. Thus, the scope of the invention should not be limited by the foregoing specification, but rather, only by the scope of the claims appended hereto.

What is claimed is:

1. A secondary seal for a liquid storage tank having a cylindrical sidewall and a floating roof comprising a weather shield means extending upwardly and outwardly from the floating roof to normally seal the peripheral junction between the roof and the sidewalls, the weather shield means terminating upwardly in a flexible wiper which is normally in contact with tank sidewall;

a vapor barrier means extending about the weather shield means to prevent the passage of vapors through the weather shield means, the vapor barrier means defining a log space outwardly of the weather shield means; and a resilient reserve seal means positioned within the log space to provide a reserve seal between the weather shield means and the tank sidewall when the flexible wipers do not contact the tank sidewall.

2. The secondary seal of claim 1 wherein the weather shield means comprises a plurality of juxtaposed panels.

3. The secondary seal of claim 1 wherein each panel terminates upwardly in a bent lip and downwardly in a bent flange.

4. The secondary seal of claim 3 wherein the flexible wipers connect to the panels at the upward bent lips.

5. The secondary seal of claim 4 wherein the panels connect to the floating roof at the respective bent flanges.

6. The secondary seal of claim 1 or claim 5 wherein the vapor barrier means comprises a length of vapor impervious, flexible material.

7. The secondary seal of claim 5 wherein the vapor barrier means comprises a length of flexible material having a top and a bottom, the top being connected to the weather shield means at the flexible wiper connection.

8. The secondary seal of claim 7 wherein the bottom of the flexible material is connected to the weather shield means at the said connection to the floating roof.

9. The secondary seal of claim 1 wherein the reserve seal means comprises a length of resilient foam material.

10. The secondary seal of claim 9 wherein the material is foam rubber.

11. The secondary seal of claim 9 wherein the material is foam plastic.

12. The secondary seal of claim 1 wherein the reserve seal means is non-circular in cross section.

13. The secondary seal of claim 1 wherein the reserve seal means is triangular in cross section.

14. The secondary seal of claim 1 wherein the wiper contacts the sidewall when the tank is not full.

15. The secondary seal of claim 14 wherein the wiper extends above the tank sidewall when the tank is substantially full.

16. The secondary seal of claim 15 wherein the weather shield means defines a clearance space with the tank sidewall when the tank is not full.

17. The secondary seal of claim 16 wherein the reserve seal means is positioned within the clearance space.

18. The secondary seal of claim 17 wherein the reserve seal means is not in contact with the tank sidewall when the tank is not full.

19. The secondary seal of claim 16 wherein the weather shield means defines a reduced space with the tank sidewall when the tank is substantially full, the distance between the weather shield means and the tank sidewall through the reduced space being less than the height of the reserve seal means, whereby the reserve seal means is squeezed between the tank sidewall and the weather shield means to effect a reserve seal when the wipers extend above the tank sidewall.

* * * * *